United States Patent [19]

Olivieri et al.

[11] Patent Number: 4,620,106

[45] Date of Patent: Oct. 28, 1986

[54] IMPACT ABSORBER FOR CONTAINERS FOR NUCLEAR FUEL AND/OR DANGEROUS SUBSTANCES

[75] Inventors: Antonio Olivieri, Milan; Giovanni Pochini, Noverasco di Opera, both of Italy

[73] Assignee: AGIP Nucleare S.p.A., Rome, Italy

[21] Appl. No.: 538,742

[22] Filed: Oct. 3, 1983

[30] Foreign Application Priority Data

Oct. 11, 1982 [IT] Italy ..... 23701 A/82

[51] Int. Cl.[4] ..... G21F 5/00

[52] U.S. Cl. ..... 250/506.1; 220/203; 220/213

[58] Field of Search ..... 250/506.1, 507.1; 220/203, 213, 361, DIG. 21; 376/272

[56] References Cited

U.S. PATENT DOCUMENTS

| | | | |
|---|---|---|---|
| 3,858,751 | 1/1975 | Gerdes | 220/203 |
| 4,192,435 | 3/1980 | Volpeliere | 220/213 |
| 4,447,729 | 5/1984 | Doroszlai et al. | 250/506.1 |

*Primary Examiner*—Bruce C. Anderson

*Attorney, Agent, or Firm*—Morgan & Finnegan

[57] ABSTRACT

This invention relates to an impact absorber for containers for nuclear fuels, radioactive products and/or dangerous chemical substances and used either for transporting or for storing said materials.

Said impact absorber is constituted by two convex shells fixed to the ends of the container by means of frusto-conical flanges and clamping half-rings, which are joined together by nuts and bolts.

19 Claims, 2 Drawing Figures

IMPACT ABSORBER FOR CONTAINERS FOR NUCLEAR FUEL AND/OR DANGEROUS SUBSTANCES

This invention relates to an impact absorber for containers for irradiated nuclear fuel, radioactive products and/or dangerous chemical substances. Its purpose is to make said containers safer and more suitable both for transporting and storage.

More particularly, the present invention relates to an impact absorber constituted by two convex shells fixed to the ends of the container by means of frusto-conical flanges and half-rings which are clamped together by nuts and bolts.

Containers for irradiated nuclear fuel are vessels of preferably cylindrical shape, are constructed of metal, preferably of large-thickness steel, are provided with at least one bolted seal cover, and are surrounded externally by a neutron shield.

According to international IAEA requirements, said containers must be subjected to a series of tests, specifically comprising: dropping the container from a height of 9 m on to an indeformable horizontal surface; exposing it for half an hour to an environment at a temperature of 800° C.; dropping it from a height of 1 m against a cylindrical steel bar of 150 mm diameter.

The impact absorber according to the present invention has brilliantly passed the tests prescribed by said international IAEA regulations, protecting the container from any possible incident.

The impact absorbers known to the art and commonly used for irradiated fuel containers are of two types:

(a) in the form of fins directly welded to the container or to a removable support, (b) of profiled wood (usually balsa), suitably encased and fixed to both ends of the container.

The aforesaid types having the following drawbacks.

Type (a) has a low specific deformability. In this respect, the maximum deformation of a fin-type impact absorber usually does not exceed 50% of the height of the undeformed fins. Moreover, it is not suitable for energy absorption in the case of a sideways fall.

This system is usually supplemented by additional energy absorbers (for example circumferential fins), the purpose of which is to absorb the kinetic energy of the container on falling sideways.

Moreover, the energy absorption obtained by such systems is hardly progressive, and induces large stresses in the container cover on impact.

With such a system it is not possible to obtain "double retention", and the energy absorption is strongly dependent on the angle of fall.

In addition, the container cover is poorly protected from thermal stresses resulting from the fire test scheduled by IAEA, and its valves are not protected from manhandling and/or acts of sabotage (which can include close "hollow charge" explosions).

Type (b), although partly overcoming the defects typical of fin-type impact absorbers, is not suitable for absorbing energy in a sideways direction. This can be obviated only by complicated shaping of the wooden blocks so as to dispose the material fibres in a direction perpendicular to the surface of impact.

There are also problems related to the constancy and uniformity of those material (wood) properties susceptible to variation under the influence of environmental factors such as temperature, humidity etc.

It has been found possible to obviate the drawbacks of the aforesaid generally adopted methods by using an anti-impact structure susbstantially different from the known types. Reference is made to the accompanying FIGS. 1 and 2.

The impact absorber according to the present invention and as shown in FIG. 2 is constituted by:

(a) two convex impact absorber shells (one for each end of the container), said convex shells being formed by joining together a first open (non-closed) convex metal structure (1) having one open end at the maximum circumference or diameter thereof at line (26) and a second annular convex metal structure (2) having its convex curvature equal to or different from the preceding, said second annular metal structure being welded at the large opening formed at its maximum circumference or diameter at line (26) to the open convex metal structure in a position corresponding to the opening of the first open convex structure which is of diameter equal to the diameter of the maximum circumference of the annular metal structure;

the annular convex metal structure (2) is welded at the minor opening approximating the dimension of the end of the container and formed at the minimum circumference or diameter of the second annular convex structure at (5) to an annular connector 3 which enables it to be connected to the container;

the connector is preferably provided, in that terminal zone thereof in contact with the container, with an outwardly directed annular projection (22), said annular projection being preferably one half of axially divided frusto-conical shape;

the annular projection (flange) can be used for connecting the shell to the container, which is provided in its turn with an opposing annular projection (backing flange) (24) of the same shape, by clamping together the two projections by means of bolts, screws, or preferably half rings (9) which are joined together by nuts and bolts, and which fit over said projections.

(b) elastomer seal rings (10) and (11) between the annular connector and the container.

(c) an aperture (12) which enables the amount of any radioactive gas leakages from the container through the gaskets (10) and (11) to be monitored.

(d) a possible additional solid neutron shield (14), the purpose of which is to reduce the $\gamma$ dose and neutron values to below the maximum values allowed by international IAEA regulations. In a preferred form of the invention, the convex shells are provided with an aperture (8) which allows pressurisation or depressurisation of the interspace between the impact absorber and the container. Said interspace between the impact absorber and container can be pressurised or depressurised with respect to the pressure of the surrounding environment in order to ensure, for determined time periods, that the leakage to the environment of the radioactive or dangerous substances contained in the container is zero. The interspace can be filled with fluids of type other than air, including at positive or negative pressure. It can also be filled completely or partly by substances which effect a neutralising, extinguishing or absorbing action on any leakages of the dangerous fluids present in the container.

The elastomer seal rings (10) and (11) together with the container gaskets (16) provide double retention for any liquid or gaseous fluids present in the container cavity, and which may have leaked through the valves (15) and main gaskets (16).

Threaded connectors (6) and (7) are also provided to allow the impact absorber to be moved (raised, displaced horizontally) with respect to its vertical or horizontal axis.

The impact absorber shells according to the present invention can be constructed of steel, titanium or any material having a high specific energy absorption capacity (aluminium, iron etc.).

Said shells can also be constructed of hard impact-resistance plastics materials if dangerous chemical substances are to be transported or stored.

Said convex import absorber shells have a thickness of the order of 0.5–6 cm, preferably 3 cm, and are characterised by the outer diameter of the convex shells exceeding the maximum overall diameter of the container by 20–40 cm, thus allowing high deformation (high energy absorption with low acceleration) without the impact affecting the primary containing system.

The convex shell impact absorber according to the present invention thus has the following advantages over the prior art:

(1) Very high percentage deformation capacity

In this respect, following axial or lateral impact, the impact absorber can deform until it reaches a limiting dimension (in the impact direction) which is only slight; greater than the thickness of the plate material from which it is constructed, without giving rise to dangerous acceleration peaks.

(2) Energy absorption capacity for any container impact angle

This prevents the need for supplementary systems for energy absorption in a lateral direction.

(3) Very progressive energy absorption

The experimental tests and the large series of numerical evaluations carried out have shown that the absorber according to the present invention, if suitably dimensioned, absorbs the container kinetic energy during the impact consequent on a 9 meter fall with a force-displacement diagram having its peak value only about 25% greater than its mean value.

(4) No external stresses in the container cover, which is not struck during any stage of the impact.

(5) Facility for obtaining "double retention" of the liquid or gaseous substances contained in the container, for normal transportation conditions This facility, obtained by the use of seal rings, reduces or in the limit nullifies the release of liquid or gaseous substances, which could occur by seepage through the container gaskets or valves. In this respect, the interspace between the impact absorber and container can be pressurised or depressurised, so nullifying release to the environment while the pressure in said interspace remains above the pressure inside the container (if the interspace is pressurised) or remains below atmospheric pressure (if the interspace is depressurised).

(6) Protection of the container cover from thermal stresses during fire tests (800° C. for 30 minutes).

(7) Protection of valves and cover (which are the least resistant components of the container) from involuntary manhandling or voluntary manhandling (sabotage), because the impact absorbers must be removed in order to gain access to them. Moreover, the thickness of the impact absorber plate material constitutes effective protection for the valves and cover against hollow charge explosions, which cannot be applied to points close to the cover surface. A further protection against this risk is offered by an incorporated neutron shield.

(8) Rapid removal of the impact absorber

The impact absorber is shown in its various parts in FIGS. 1 and 2 by way of non-limiting example.

Figure 1:
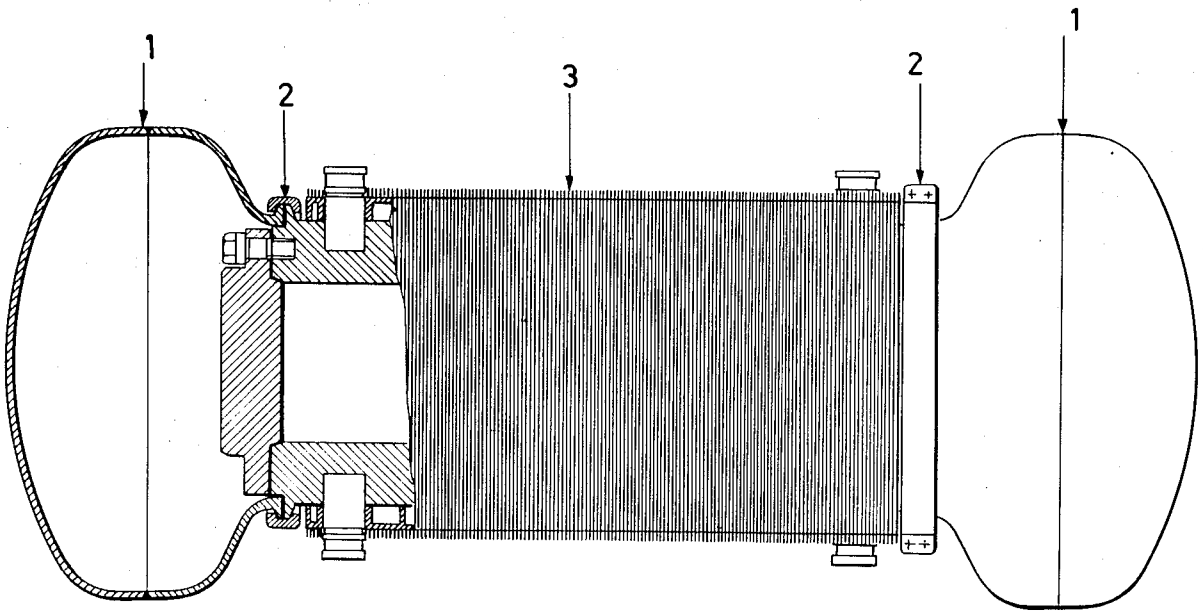
FIG. 1 shows the complete assembly comprising the container and impact absorber. The clamping rings (2) join the container (3) to the absorber (1).
Figure 2:
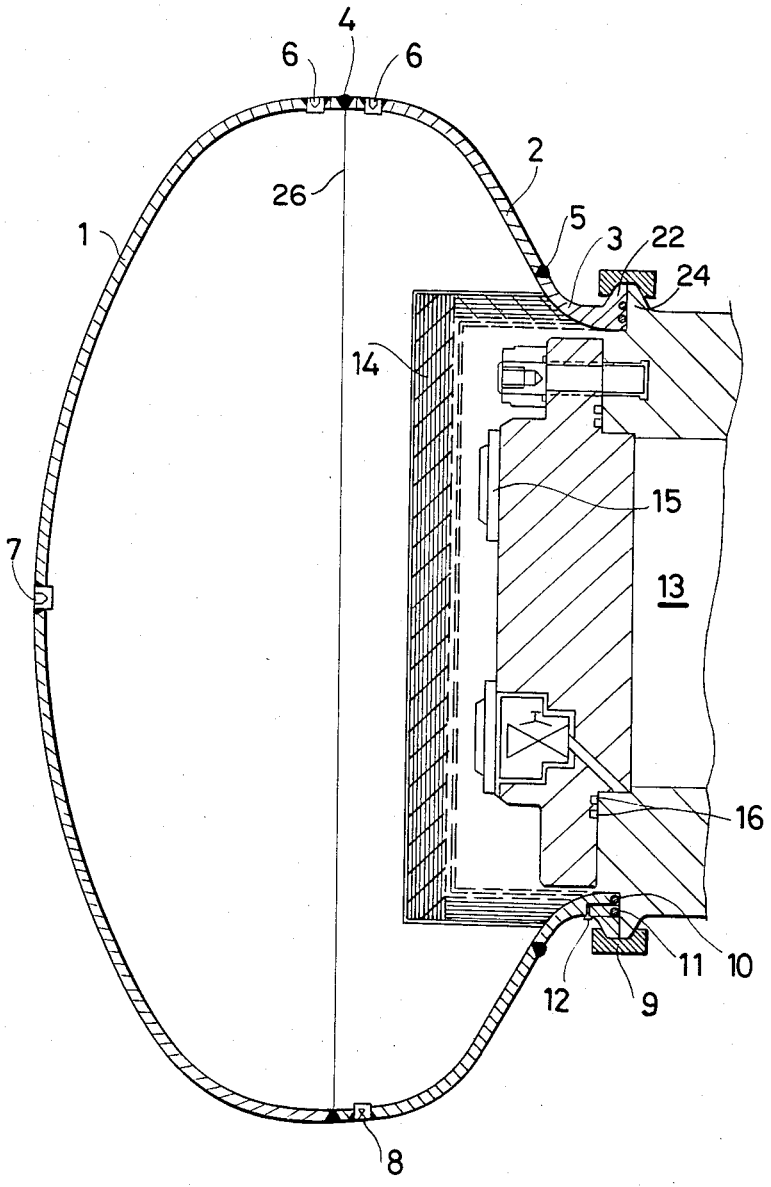
FIG. 2 shows the two convex shells (1) and (2) joined together by the circumferential weld (4) and to the frusto-conical flange (3) by the circumferential weld (5).

The reference numeral (9) indicates the pairs of clamping half-rings. The reference numerals (10) and (11) indicate the elastomer seal rings, (15) the valves, (16) the main gaskets of the container (13), (8) the pressurisation (or depressurisation) connection, and (14) the additional neutron shield.

The reference numerals (6) and (7) represent the connectors necessary for moving the impact absorber, and (12) the aperture through which the rate of leakage from the gaskets (10) and (11) is monitored.

We claim:

1. An impact absorber for a container for irradiated nuclear fuels, radioactive products and/or dangerous chemicals comprising:

a first open convex structure having one open end at its maximum diameter;

a second annular convex structure having a large opening formed at the maximum diameter of said second annular convex structure, said large opening corresponding to said open end of said first open convex structure, said second annular convex structure having a minor opening formed at the minimum diameter thereof and approximating the dimension of the end of the container, said first open convex structure and said second annular convex structure being connected at said first structure open end and said second annular convex structure large opening to form an impact absorber shell;

an annular connector attached to said second annular convex structure at said minor opening; and ring connector means for connecting said impact absorber shell at said annular connector to said container, said impact absorber shell and said container defining an interspace therebetween, said interspace being pressurized or depressurized relative to the surrounding environment to prevent release to the environment of the substances contained in the container.

2. The impact absorber as claimed in claim 1, wherein the convex curvature of said second annular convex structure is equal to the convex curvature of said first open convex structure.

3. The impact absorber as claimed in claim 1, wherein said annular connector includes an outwardly directed annular projection adjacent said minor opening.

4. The impact absorber as claimed in claim 3 wherein said annular projection is in the shape of one-half of an axially divided frusto-conical form.

5. The impact absorber as claimed in claim 4 wherein said ring connector means comprises a ring clamp engaging said annular projection and a corresponding backing flange on the container, said backing flange having the shape of an opposing half of an axially divided frusto-conical form.

6. The impact absorber as claimed in claim 5, wherein said ring clamp further comprises two half rings joined together by nuts and bolts.

7. The impact absorber as claimed in claim 1, wherein said impact absorber shell has a thickness of between 0.5 cm. and 6 cm.

8. The impact absorber as claimed in claim 1, wherein the maximum diameter of said impact absorber shell exceeds the maximum overall diameter of the container by 20–40 cm.

9. The impact absorber as claimed in claim 1, wherein said impact absorber shell is constructed of a material having high specific energy absorption capacity.

10. The impact absorber as claimed in claim 1, wherein said interspace is filled with a fluid.

11. The impact absorber as claimed in claim 1, wherein said interspace is at least partially filled with substances which exert a neutralising action on any substance leaked from the container.

12. The impact absorber as claimed in claim 1, further comprising one or more elastomeric sealing rings disposed between said annular connector and the container.

13. The impact absorber as claimed in claim 12, wherein said elastomeric sealing rings are provided with access bore means for monitoring any leakage from the container.

14. The impact absorber as claimed in claim 9, wherein said material is metal.

15. The impact absorber as claimed in claim 1, further comprising a neutron shield over the end of the container in said interspace to reduce gama dose and neutron values.

16. The impact absorber as claimed in claim 1, wherein said convex impact absorber shell has a thickness of 3 cm.

17. The impact absorber as claimed in claim 1, wherein said metal convex shells are welded together.

18. The impact absorber as claimed in claim 9, wherein said material is plastic.

19. The impact absorber as claimed in claim 1, further comprising aperture means provided in said impact absorber shell for pressurizing or depressuring said interspace.

* * * * *